US007284741B2

(12) United States Patent
Pierce

(10) Patent No.: US 7,284,741 B2
(45) Date of Patent: Oct. 23, 2007

(54) CANDLE MELTING SYSTEM

(75) Inventor: Jillianne Pierce, Portland, OR (US)

(73) Assignee: Access International Inc., Portland, OR (US)

( * ) Notice: Subject to any disclaimer, the term of this patent is extended or adjusted under 35 U.S.C. 154(b) by 153 days.

(21) Appl. No.: 10/540,340

(22) PCT Filed: Dec. 19, 2003

(86) PCT No.: PCT/US03/40602

§ 371 (c)(1),
(2), (4) Date: Jun. 20, 2005

(87) PCT Pub. No.: WO2004/060018

PCT Pub. Date: Jul. 15, 2004

(65) Prior Publication Data

US 2006/0081585 A1 Apr. 20, 2006

Related U.S. Application Data

(60) Provisional application No. 60/435,531, filed on Dec. 20, 2002.

(51) Int. Cl.
*C11C 5/02* (2006.01)
*B67D 5/63* (2006.01)

(52) U.S. Cl. ..... 249/139; 249/78; 249/97; 425/803

(58) Field of Classification Search ..... 249/78, 249/93, 94, 97, 139; 425/803
See application file for complete search history.

(56) References Cited

U.S. PATENT DOCUMENTS 3,015,847 A 1/1962 Holden et al.
3,385,649 A 5/1968 Hicks
3,724,982 A 4/1973 Davis
3,744,956 A 7/1973 Hess
3,878,360 A * 4/1975 Augustine et al. ..... 392/444
3,891,179 A * 6/1975 Berman ..... 249/134
3,958,936 A 5/1976 Knight, Jr.
3,974,996 A 8/1976 Violet
4,030,867 A 6/1977 Everman
4,826,428 A 5/1989 Lam
5,078,945 A 1/1992 Byron
5,632,615 A 5/1997 DeGarmo
5,988,446 A 11/1999 Schitter
6,098,953 A * 8/2000 Machado ..... 249/93
6,220,855 B1 4/2001 Asheim
6,412,670 B1 * 7/2002 Randmae et al. ..... 222/452
6,457,962 B1 * 10/2002 Elmore ..... 425/110
6,902,387 B2 * 6/2005 Cziraky ..... 425/144

FOREIGN PATENT DOCUMENTS

FR 2556004 A1 * 6/1985

* cited by examiner

*Primary Examiner*—Yogendra N. Gupta
*Assistant Examiner*—Dimple N. Bodawala
(74) *Attorney, Agent, or Firm*—Smith-Hill and Bedell

(57) ABSTRACT

A candle melting system includes a candle shaper having a guard that operatively separates a handle from a wax cutting blade is thermally controlled by a heating assembly. The candle melting system also includes a candle mold that includes an outer kiln that is sized to accommodate an inner mold. In some embodiments, the inner mold includes a heat sink positioned near the bottom of the inner mold. The candle mold includes a wick placement assembly configured to hold a wick in place so that wax can be melted around the wick to form a custom candle.

20 Claims, 4 Drawing Sheets

CANDLE MELTING SYSTEM

CROSS-REFERENCE TO RELATED APPLICATIONS

This application is a 371 of PCT/US03/40602, filed on Dec. 19, 2003, which claims the benefit of U.S. Provisional Application No. 60/435,531, filed on Dec. 20, 2002, the content of which is incorporated by reference.

BACKGROUND

Candles are a popular household item. They may be manufactured in many sizes and shapes and in a variety of colors. Candles may be scented so as to provide a pleasant fragrance while burning. The open flame of a candle produces a soft warming light that is considered pleasant by many people. Because candles do not rely on outside energy sources, they are useful as an alternative lighting source during power outages or other circumstances when electric lights are not available.

The original shape of a candle changes as it burns. Sometimes the wick is submerged in molten wax. When the molten wax cools, it hardens and the wick can be lost. As the candle burns, molten wax drippings often run down the sides of a candle onto the surface supporting the candle, thus creating a potential fire hazard. When the molten wax cools, it hardens, leaving candle drippings on the sides of the candle and a hardened wax pool at the candle's base. Sometimes the wax nearest the wick burns too quickly and forms a deep well in the center of the candle. A thick wall of wax around the edge of the candle is left unburned and blocks the light produced by the burning wick. Such uneven burning and wax drippings can impact the aesthetics of the candle.

A candle often burns through its wick before all of its wax has been used. Other times, a candle that still has wick left will have changed form through burning and is no longer desirable. In these and other similar situations, there is a substantial amount of candle wax that may go wasted.

DETAILED DESCRIPTION AND BEST MODE

Figure 1:
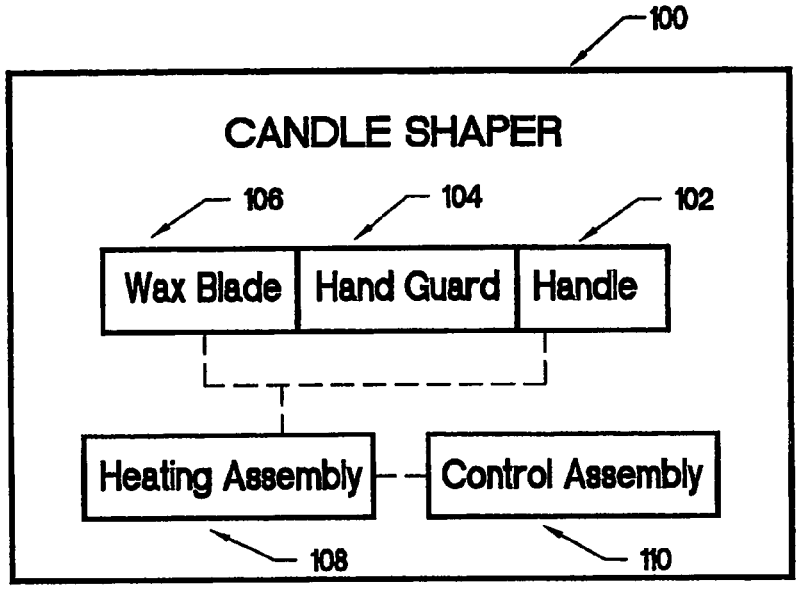
FIG. 1 is a schematic block diagram of a candle shaper.

FIG. 1 schematically shows a candle shaper 100 that includes a handle 102, hand guard 104, wax blade 106, heating assembly 108, and control assembly 110. Candle shaper 100 may be variously configured while remaining within the scope of this disclosure. In particular, the size and shape of handle 102, hand guard 104, and wax blade 106 may be configured for a particular candle cutting operation. Furthermore, heating assembly 108 may be selected to cooperate with a particular wax blade and handle to sufficiently heat the wax blade while not overheating the handle. The following description is directed towards a nonlimiting example of one such candle shaper.

FIGS. 2-8 show an exemplary candle shaper 100 having a handle 102 in the form of an elongated gripping surface adapted to ergonomically interact with a human hand. Handle 102 may be shaped to receive a right hand, a left hand, or alternatively may be symmetrically shaped to receive either a right hand or a left hand. Handle 102 may be any suitable shape that allows gripping, and preferably will be shaped so as to be comfortable and maneuverable within a human hand. Handle 102 may be made from plastic, metal, wood, glass, and/or any other suitable material. Preferably, handle 102 is a poor thermal conductor so that heat from candle shaper 100 does not transfer from the handle to a hand gripping the handle. Similarly, handle 102 is preferably well insulated so that the transfer of heat from wax blade 106, or other portions of the candle shaper, to a users hand can be minimized.

Hand guard 104 acts as a physical barrier between handle 102 and wax blade 106. In the illustrated embodiment, hand guard 104 extends downwardly from an interface between handle 102 and wax blade 106. Hand guard 104 may be any shape that effectively protects a user's hand. Hand guard 104 can protect a hand from touching the heated portions of the candle shaper and/or molten wax. In some embodiments, the hand guard may curve away from the handle, so as to offer a path for melted wax to flow away from the user's hand. The hand guard may be made from any suitable material including metal, glass, and/or plastic. Hand guard 104 preferably has a high melting temperature so that its physical characteristics will not be affected by operation of candle shaper 100. Hand guard 104 also preferably is well insulated and a poor thermal conductor so as to protect a users hand.

Figure 2:
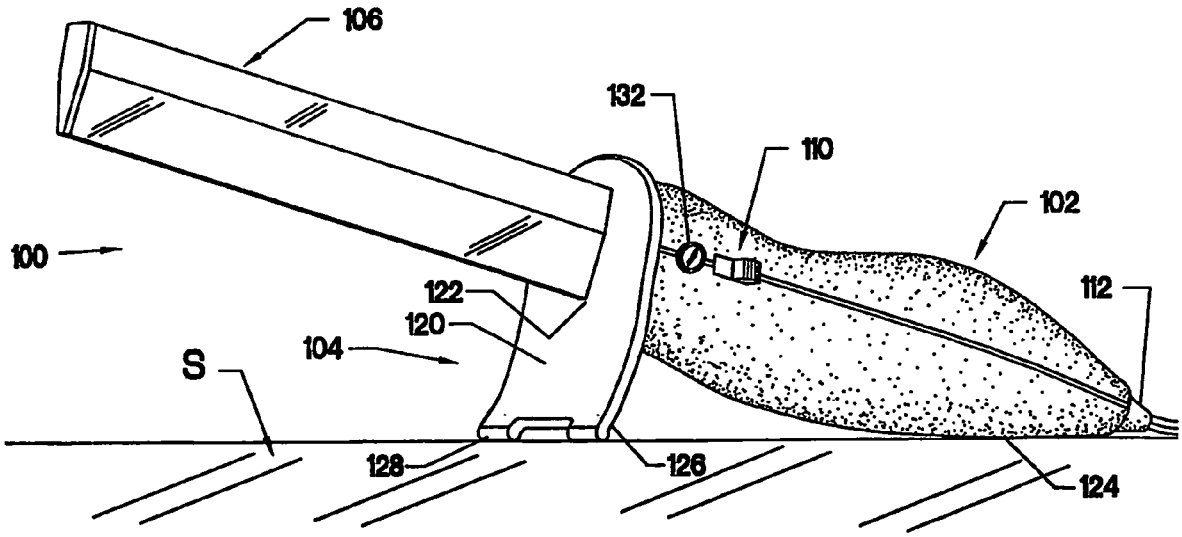
FIGS. 2-8 show an exemplary embodiment of the candle shaper of FIG. 1.
Figure 3:
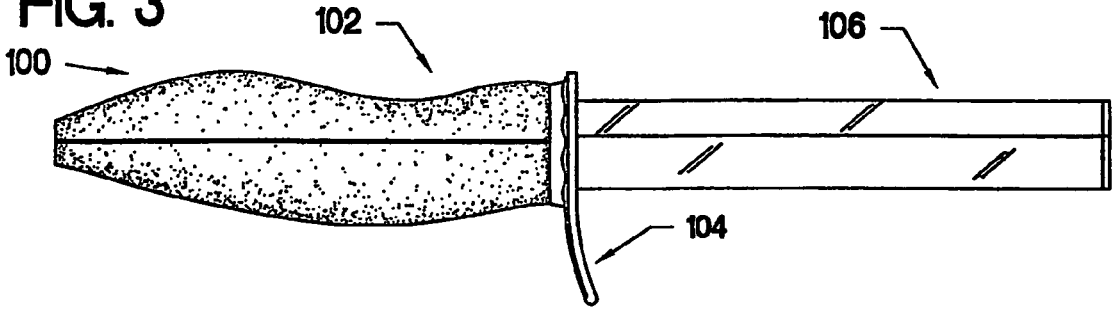
Figure 4:
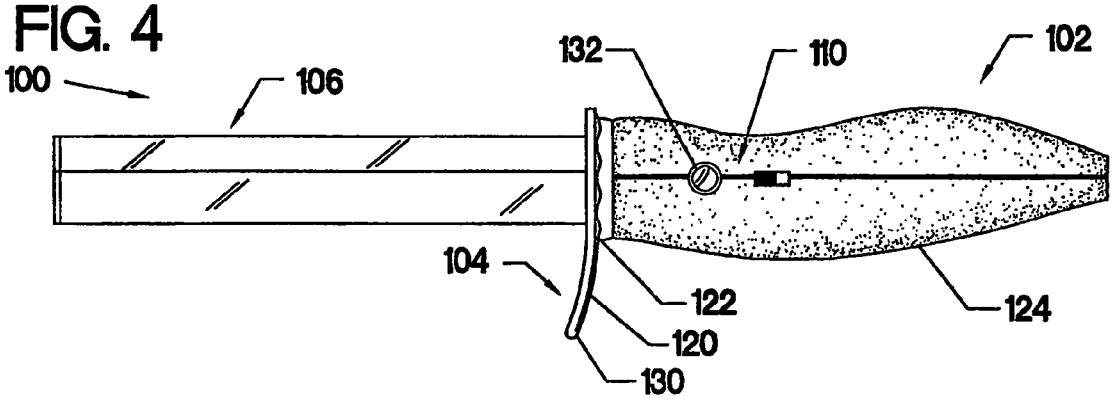
Figure 5:
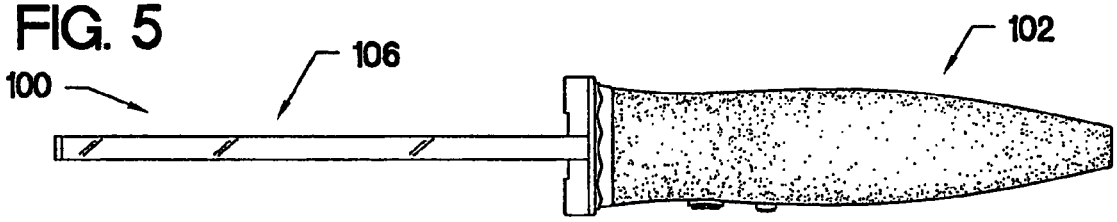
Figure 6:
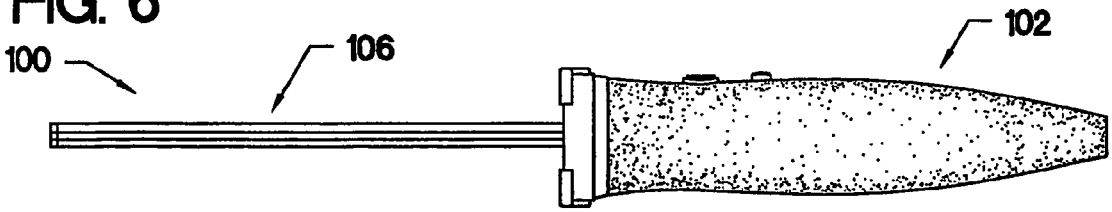

As best shown in FIGS. 2 and 4, a protecting portion 120 of the hand guard extends downwardly from a connection portion 122 of the hand guard. As illustrated in FIG. 2, candle shaper 100 can be securely placed on a surface S. Handle 102 and hand guard 104 provide a stable base for setting the candle shaper in a seated position. Handle 102 includes a contact portion 124, which contacts surface S when the candle shaper is in a seated position. Hand guard 104 includes a left foot 126 and a right foot 128, providing discrete contacts when the candle shaper is in a seated position. In other words, candle shaper 100 can be placed on a surface so that contacting portion 124, and feet 126 and 128 effectively act as a tripod for the candle shaper.

Candle shaper 100 can be configured so that wax blade 106 is held above surface S when the candle shaper is in a seated position. The size and shape of hand guard 104 can be designed to hold the wax blade a desired distance above the surface. In the illustrated embodiment, hand guard 104 has a concave curvature with reference to wax blade 106. The curvature of the hand guard increases the distance between feet 126 and 128 relative to contacting portion 124. Furthermore, the curvature effectively places feet 126 and 128 farther in front of the candle shaper's center of mass, so that the wax blade is more securely held above surface S. In other words, the curvature of hand guard 104 stabilizes the candle shaper in a seated position. The forward placement of feet 126 and 128 helps prevent wax blade 106 from tipping forward out of a seated position.

Figure 7:
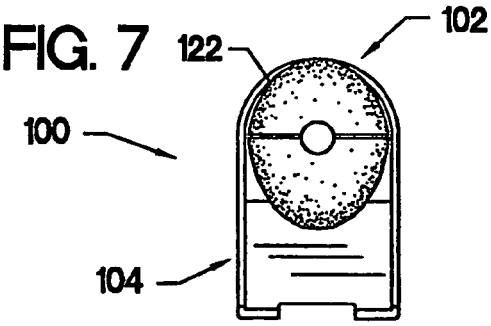
Figure 8:
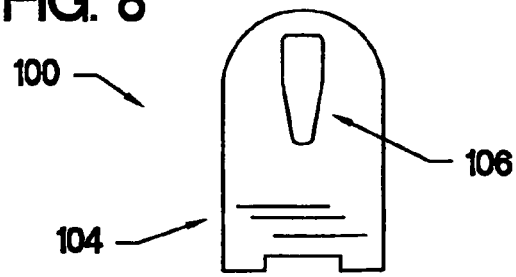

As best shown in FIG. 7, a connection portion 122 of the hand guard generally follows the profile of the upper portion of the handle. Such a configuration does not obstruct a user's view of wax blade 106. In some embodiments, the hand guard may extend upwardly from connection portion 122, providing more separation between a user's hand and wax blade 106. To limit visual obstruction, in some embodiments an upwardly extending portion of hand guard 104 may be at least partially transparent, so the wax blade can be seen through the hand guard. The illustrated hand guard is approximately the same width as handle 102. In some embodiments, the hand guard may be differently sized. For example, a relatively wider handle may be used to widen support provided by feet 126 and 128.

As best shown in FIG. 4, the hand guard includes a reference edge 130 that is configured for positioning against surface S. In the illustrated embodiment, reference edge 130 includes the above described feet 126 and 128. The reference edge can be used to position the blade at a fixed cutting angle relative to the surface. For example, a reference edge can be configured to position the wax blade perpendicular to a cutting surface on which a candle is placed, thereby facilitating controlled cuts through the candle. In this manner, the reference edge may be used as a fulcrum, and the wax blade may cut through at least a portion of a candle while the reference edge remains contacting surface S. The continuous contact between surface S and the reference edge ensures that the wax blade keeps a fixed cutting angle. In some embodiments, the candle shaper may be configured to cooperate with a cutting jig, which can be used to hold the candle still during the cutting process.

Wax blade 106 may be thermally controlled by a heating assembly that converts external energy into thermal energy that is transferred to the wax blade. The heating assembly 108 can include an electrically conductive component that receives a standard alternating current. The current can run through the electrically conductive component, such as an electrically-conductive coiled wire (resistor), thus emitting thermal energy from the component. In some embodiments, the heating assembly may include a mica heater. Ideally, the heating assembly efficiently transfers the thermal energy to wax blade 106.

The heating assembly may convert alternating current, direct current, or other forms of energy into thermal energy. For example, the heating assembly may receive energy from an electrical outlet via a power cord. For example, a "swivel cord" 112 that is moveably connected to the handle 102 may be used to deliver alternating current to the heating assembly. In such embodiments, the heating assembly may include a transformer for converting alternating current into direct current. In some embodiments, the heating assembly may receive energy from one or more direct current batteries. The heating assembly, or a portion thereof, can be positioned within handle 102 and/or wax blade 106. A portion of the heating assembly can be located between hand guard 104 and wax blade 106. In some embodiments, the heating assembly can be configured as a thermally conductive holster in which candle shaper 100 may be placed and heated.

Candle shaper 100 includes a control assembly 110, which is used to set the temperature of wax blade 106. In some embodiments, control assembly 110 may include a switch that can turn the heating assembly on and off. In some embodiments, control assembly 110 may include a variable temperature selector, that can set the wax blade at one of a plurality of different temperatures. The control assembly may also include a status indicator 132, which can visually and/or audibly provide information corresponding to the temperature of the blade and/or the state of the heating assembly. For example, a light may indicate that the heating assembly is on. In some embodiments, a light and/or a sound may be used to indicate that the blade has reached a desired temperature.

Wax blade 106 can be used to shape candles. It receives thermal energy from a heating assembly and transfers the thermal energy to the candle wax. The candle wax becomes temporarily molten and may be manipulated with wax blade 106. Wax blade 106 can be constructed from a thermally conductive metal, such as aluminum. Wax blade 106 may alternatively be made from other suitable materials. The wax blade may include a non stick substrate and/or coating.

It is understood that the shape and size of wax blade 106 may be set according to desired candle shaping characteristics. In the illustrated embodiment, candle shaper 100 has a fixed wax blade 106. In an alternative embodiment, candle shaper 100 may be adapted to selectively receive one of a plurality of interchangeable wax blades that may be individually designed for a particular wax shaping characteristic.

Figure 9:
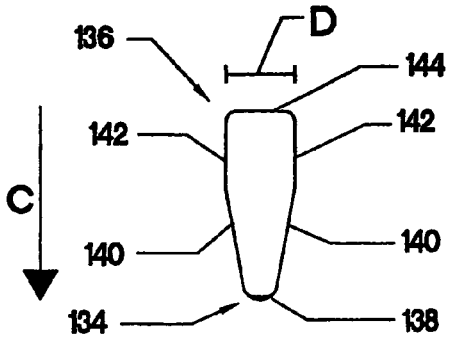
FIG. 9 Is a cross section of an exemplary wax blade for use with a candle shaper.

Wax blade 106 may be an elongated member having a cross section designed to efficiently cut through a candle. FIG. 9 is a cross-section view of wax blade 106. Unlike many knives or other cutting instruments that utilize a finely sharpened blade to slice, or a serrated blade to saw, wax blade 106 utilizes heat to melt. The wax blade can be used to push through melted wax, effectively cutting the temporarily molten wax. However, melted wax eventually cools and solidifies. To limit melted wax from reforming in a contiguous mass behind wax blade 106, the wax blade may be shaped so as to produce a more substantial kerf, or otherwise keep separated candle portions from rejoining.

As shown in FIG. 9 with reference to a cutting direction C, wax blade 106 includes a front portion 134 and a back portion 136. The front portion includes a blunt cutting edge 138, that is configured to first contact a candle. The blunt cutting edge does not come to a sharp edge, such as many traditional knives. In fact, the cutting edge is characterized by a slightly curved profile. The front portion also includes tapered sidewalls 140 extending back from the cutting edge. The thickness of the wax blade increases from front to back along the length of the tapered sidewalls. The back portion of the blade includes substantially parallel sidewalls 142 extending back from the tapered sidewalls. The parallel sidewalls are spaced a width D. The back portion of the blade also includes a trailing edge 144 that is substantially perpendicular to the parallel sidewalls.

The cutting edge portion of wax blade 106 is narrower than the back portion of the blade. A relatively narrow cutting edge allows cuts to be accurately initiated. The width of the blade increases from front to back, effectively increasing the kerf of the blade. As mentioned above, a relatively wide kerf can facilitate cutting a candle into separate pieces that do not immediately rejoin as a common piece after the blade has made the cut. For example, a blade can be constructed with a width of approximately 1/16 inch to 1/4 inch, or another suitable width that produces a kerf substantial enough to effectively separate a candle into two or more pieces.

The above described and illustrated wax blade is provided as a nonlimiting example. In other embodiments, the wax blade may be longer, shorter, wider, narrower, or a completely different geometry. For example, it should be understood that cylindrical blades that come to a point, cylindrical blades with a blunt end, knifelike blades, triangular blades, and blades of numerous other geometries can be independently useful for different wax shaping tasks. It should also be understood that wax blades designed to leave an ornamental or functional design on the wax may be used.

A candle shaper may be used to sculpt custom candles, cut candles to a desired size, or otherwise cut candles or other meltable items. For example, a candle shaper may be used to retrieve a wick lost within a candle. To this end, wax blade 106 can be heated by heating assembly 108. The heated blade can be used to cut off the top of the candle so that the previously engulfed wick is exposed. The wax that is cut away from the rest of the candle may be saved for recycling.

Figure 10:
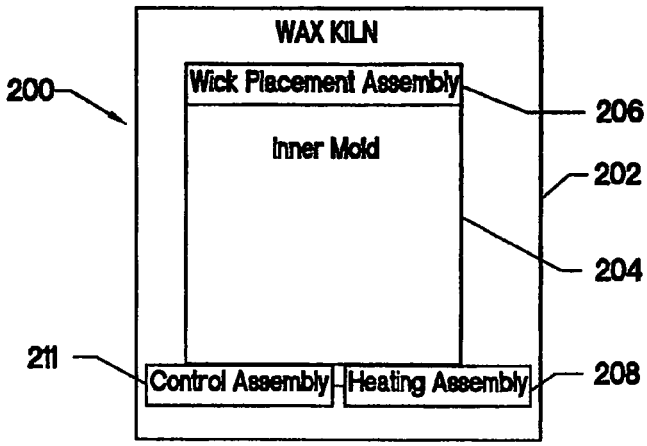
FIG. 10 is a schematic block diagram of a candle mold.

FIG. 10 schematically shows a candle mold 200 configured to melt pieces of wax into a candle. The candle mold can be used to melt recycled pieces of unused wax that have been left over from other candles and/or new pieces of wax may be used to form custom candles. For example, wax having desired colors, scents, and/or textures can be purchased or recycled from other candles to form a new custom candle. Pieces of wax can be placed into the mold and heated to a molten state. The liquid wax takes the shape of the mold and then can be cooled to a solid state. Furthermore, candle decorations such as glitter and cinnamon sticks can be added to further customize the candle design. The new candle may then be removed from the mold.

Candle mold 200 may include an outer wax kiln 202 and a removable inner mold 204. The candle mold may also include a heating assembly 208 for heating wax within the mold. A control assembly 211 may be used to control operation of the heating assembly. The candle mold may also include a wick placement assembly 206 configured to hold a wick in place while wax is melted and solidified around the wick. In this manner, a fully functional custom candle may be formed.

The candle mold may be variously configured while remaining within the scope of this disclosure. In particular, the size and shape of the wax kiln, inner mold, and wick placement assembly may be configured for a particular candle molding operation. Furthermore, heating assembly 108 may be selected to cooperate with a particular wax kiln and inner mold to sufficiently heat wax within the mold while not overheating an outer surface of the candle mold. The following description is directed towards a nonlimiting example of one such candle mold.

Figure 11:
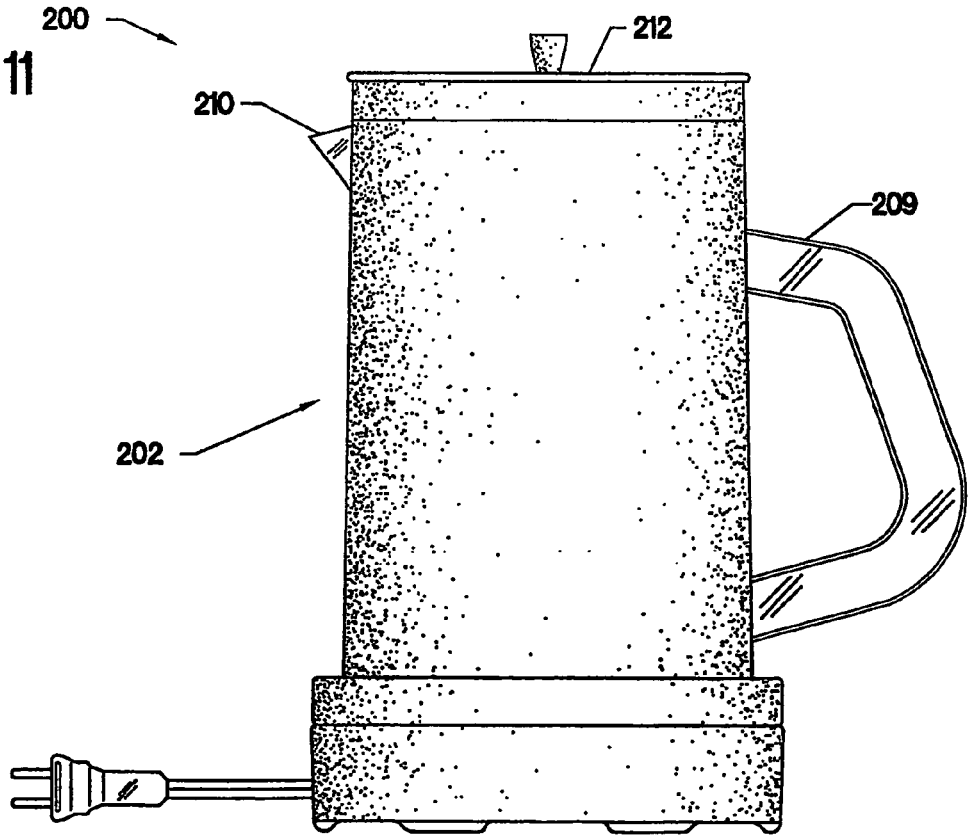
FIG. 11 shows an exemplary embodiment of a wax kiln for use with the candle mold of FIG. 10.

FIG. 11 shows candle mold 200, which can be configured with an outer wax kiln 202 that is shaped similar to a pitcher, or other apparatus configured for pouring. To this end, the wax kiln can include a handle 209 and/or a spout 210. In other embodiments, the melting device may be configured with different shapes and/or sizes. Wax may be melted directly in the wax kiln, and molten wax may then be poured from the wax kiln to an auxiliary mold, where the wax can solidify into the shape of that mold. Wax may also be poured onto or into other objects, thus providing great flexibility in creating custom candles and/or wax figures.

Wax kiln 202 can be configured with an outer body that is a poor thermal conductor. The wax kiln can be constructed from a material suited to withstand multiple heatings and coolings. For example, wax kiln 202 can be constructed from approximately ¼ inch ceramic material. It is understood that wax kiln 202 may be uniformly constructed from a single material or may alternatively be constructed from a plurality of materials. For instance, in some embodiments, a wax kiln may be constructed from a metallic inner surface, an insulating core, and a metallic or plastic outer surface.

The candle mold may include a heating assembly that is configured to melt wax within the candle mold. The heating assembly is used to convert external energy into thermal energy. The thermal energy can be transferred to wax held within the candle mold, thereby promoting the heating and melting of the wax. The heating assembly may be any suitable device capable of producing enough heat to melt wax held within the candle mold. For example, the heating assembly may include a hot plate that is positioned near the base of the candle mold. As another example, the heating assembly may include a mica heater that includes a coiled heating wire that is positioned along sidewalls of the candle mold. The heating assembly may be powered by alternating current, which can be delivered via a power cord. The heating assembly may be thermally regulated by a thermostat or similar mechanism so that wax will not be overheated and combust, dangers present in other candle forming methods.

The candle mold may include a control assembly configured to control operation of the mold. In some embodiments, the control assembly may include a simple on/off switch. In some embodiments, the control assembly may facilitate a greater level of control. For example, the control assembly can include a dial capable of selecting one of three selectable operating states: off, melt wax, and cool down. In some embodiments, a control assembly may be configured to allow selection of a particular temperature in a range of temperatures. In some embodiments, the melting device may include two or more controls, such as a switch used to select a general operating state (i.e. on or off), and a dial to select an operating temperature or a period of operation.

The candle mold may include a lid 212. The lid can be configured to seal the candle mold, thereby preventing unwanted items from entering the candle mold, such as dust. The lid protects unwanted items from undesirably mixing with melted wax. The lid may be constructed from the same material as wax kiln 202 or another suitable material.

Figure 12:
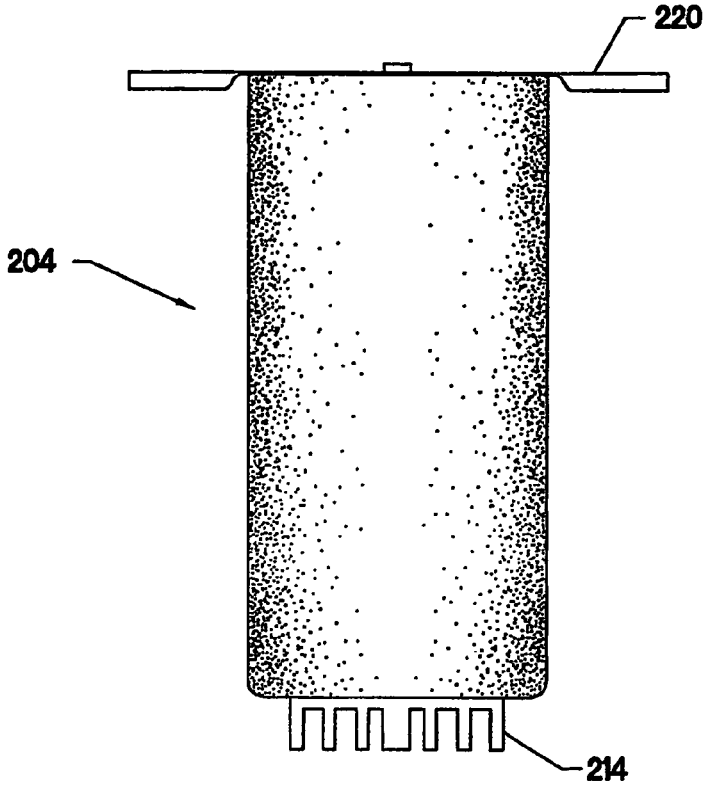
FIG. 12 shows an exemplary embodiment of an inner mold for use with the candle mold of FIG. 10.

FIG. 12 shows an inner mold 204 that is adapted to be placed in wax kiln 202. The inner mold is shaped to closely fit within the wax kiln. A close fit facilitates the transfer of heat from the wax kiln to the inner mold, which in turn facilitates efficient melting of wax within the mold. The inner mold may also include a heat sink 214, which can be used to promote thermal transfer. For example, the heat sink may facilitate transferring heat from a heating assembly to the inner mold when the inner mold is in the wax kiln and/or transferring heat from the inner mold to an ambient atmosphere when the heating assembly is turned off and/or the inner mold is removed from the wax kiln. In particular, the heat sink can be used to effectively drain heat away from the bottom of the mold. This can be useful in maintaining a more balanced temperature from the top of the mold to the bottom of the mold. If the top of the mold were allowed to cool substantially faster than the bottom of the mold, the resulting candle may form with a well, which would have to be back filled. Heat sink 214 may be constructed from aluminum or a similar highly thermally conductive material. As illustrated, the heat sink can include a highly irregular surface including a plurality of fins, so as to increase surface area without increasing total volume. Increased surface area can improve the ability of the heat sink to dissipate heat away from the inner mold. The heat sink may be spot welded to the inner mold in some embodiments.

The shape of the inner mold determines the shape of candles made in the inner mold. Wax can be placed in the inner mold and heated to a molten state. The molten wax is contained by the inner mold, and when the wax is allowed to cool and harden, its shape corresponds to the shape of the inner mold. The candle mold may be adapted to use an inner mold of one particular dimension, or the candle mold may be capable of using a variety of inner molds that form candles of different sizes and/or shapes. Inner mold 204 may be constructed from any suitable material including aluminum.

Although shown as a cylindrical inner mold, it should be understood that inner molds of virtually any geometry may be used. The outer profile of an inner mold may be configured to fit within the inner profile of a wax kiln. Accordingly, the inner mold may take on a variety of different shapes, depending on a selected configuration of the wax kiln. Furthermore, a cavity of the inner mold can be shaped to produce a desired shape of candle. In the illustrated embodiment, the cavity is generally cylindrically shaped. However, the inner mold may be configured with different shapes. In some embodiments, two or more inner molds having different cavity shapes may be used with the same wax kiln, thereby providing a selection of desired candle shapes.

An inner mold may be configured with a substantially unchangeable size and shape, or the inner mold may be configured with one or more moveable parts that facilitate adjusting the size and/or shape of the mold. For example, an inner mold may include a hinge, so that the inner mold can be effectively opened, thereby facilitating extraction of a formed candle. The inner mold can be configured with a tension release, which allows the diameter of the inner mold to slightly flex, thereby facilitating extraction of a formed candle.

As shown in FIG. 12, the inner mold may include handles 220, which facilitate the insertion and/or removal of the inner mold relative to the wax kiln. Handles 220 may be constructed from a poor thermal conductor, such as plastic, so that heat from the inner mold is not transferred to the hands of a user. Handles 220 may additionally or alternatively be at least partially thermally insulated from the inner mold. For example, contact area between the handles and the inner mold may be minimized, so as to limit thermally conductive paths through which heat can flow. As another example, a poor thermal conductor may be positioned between the handle and the inner mold, so that heat transfer is decreased. In some embodiments, the handles may be spot welded to the inner mold. Handles 220 may be larger than the opening of the wax kiln and may be positioned on the inner mold so as to rest adjacent the opening of the wax kiln. In some embodiments, the inner mold and handles can be configured so that the handles support at least some of the weight of the inner mold when the inner mold is placed in the wax kiln.

Figure 13:
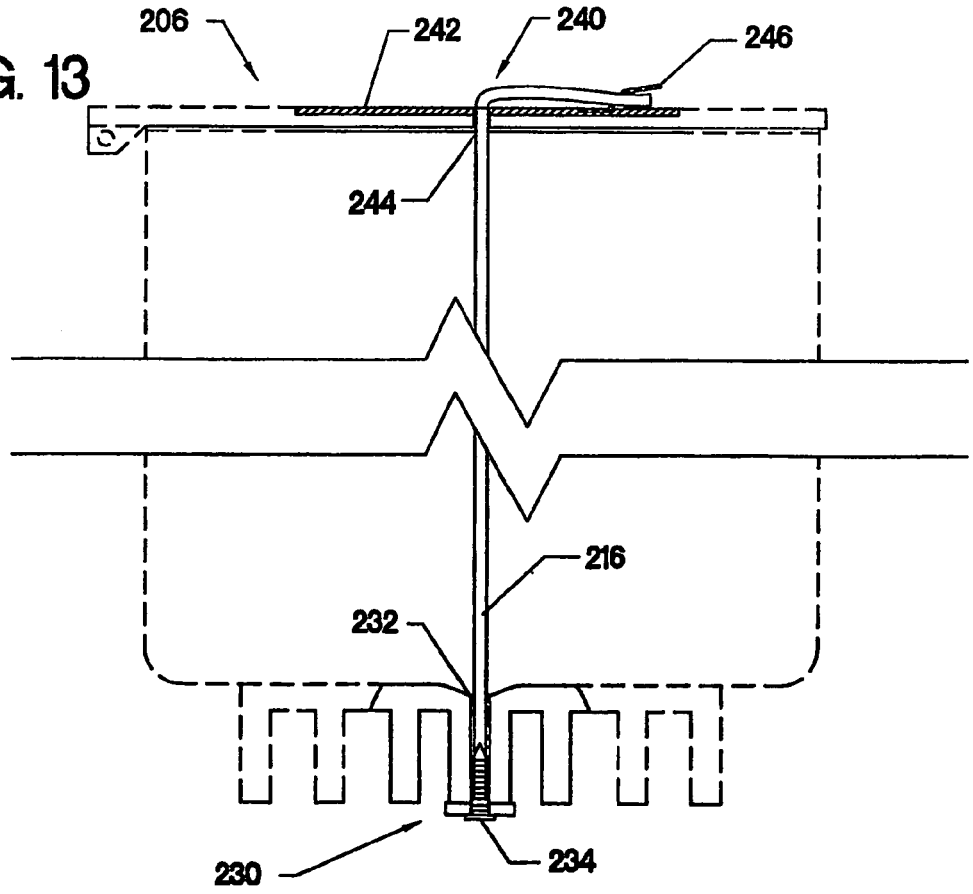
FIG. 13 shows an exemplary wick placement assembly for use with the candle mold of FIG. 10.

As shown in FIG. 13, the candle mold can include a wick placement assembly 206 configured to position a candle wick 216 so that melted wax may form around the wick. In the illustrated embodiment, the wick placement assembly includes two wick securing mechanisms positioned on opposite ends of the inner mold. At the bottom of the mold, which can correspond to the top of the candle in some embodiments, is a first wick securing mechanism 230. Wick securing mechanism 230 includes a channel 232 sized to receive wick 216. The wick securing mechanism also includes a plug 234 that is sized to seal channel 232, and may at the same time hold the wick within the channel. In some embodiments, the channel and the plug may be configured with complementary threads, so that the plug can be screwed into the channel, which can help the plug effectively hold the wick between the plug and the channel wall. The wick securing mechanism may include a washer or other additional structure to improve the sealing function of the plug, and thereby limit undesired leaking of wax through the channel.

In some embodiments, a candle mold may include a spare wick loom. For example, a spare wick loom may be located in a base of the candle mold. The spare wick loom can include a length of candle wick that may be used in newly formed candles. In some embodiments, a loom cover may be placed over the spare wick loom, thus sealing the spare loom from molten wax during candle forming. The loom cover can be configured with a hole adapted to allow an end of candle wick to be passed into the melting chamber of the candle mold, via channel 232 for example. The spare wick loom can be configured to allow a candle wick to be easily pulled into the melting chamber. The spare wick loom may rest at the bottom of the wax kiln, may be spun around a mechanical reel that assists with wick dispersal, or may alternatively use any other adequate wick delivery mechanism.

At the top of the mold is a second wick securing mechanism 240 that includes a bridge 242 that effectively spans the opening of the inner mold. The bridge may be configured to be easily moved into position across the top of the inner mold. In some embodiments, the bridge may hinge from one side of the mold. In some embodiments, the bridge may be completely removable from the inner mold. The wick securing mechanism can be configured with a wick guide 244 aligned above channel 232. Wick 216 can be thread through wick guide 244 so that it is positioned in a desired position, such as running coaxial with a longitudinal axis of the inner mold. Wick securing mechanism 240 may also include a fastener 246, such as a spring clip that can hold the wick tightly against the bridge, or another suitable arrangement that allows the wick to be held taut. The above description is directed to a candle mold that is designed to form candles having a single wick. It should be understood that the design may be modified to accommodate the formation of candles having more than one wick.

The above described candle mold may be used to form custom candles. For example, a wick may be secured in place, such as by passing a wick through channel 232, through the melting chamber, and into a fastened position at bridge 242. Plug 234 can be put in position to seal the bottom of the mold, and the bottom of the wick can be cut to proper size if it is too long. Portions of wax stock can be put in the inner mold and the wax kiln can be used to heat the wax and form a new candle. Additional wax may be added as the wax melts, such as to compensate for dead space that may exist between pieces of wax before they melt. After the wax is melted, the wax may be allowed to cool. The plug may then be removed to release the wick at the bottom of the mold, and the wick can be cut or otherwise unattached from the bridge. The bridge can then be moved out of the way, and the candle can be removed from the mold. To facilitate extracting the candle from the mold, the inside walls of the inner mold may be a non stick surface, such as aluminum. Furthermore, a nonflammable lubricant can be applied to the walls to achieve increased lubrication.

The candle mold may be constructed from a combination of materials. In some embodiments, the candle mold includes a metallic inner surface or similar surface configured to efficiently conduct heat. Likewise, the melting device may include an outer surface made from ceramic, or another material configured to insulate thermal transfer. The melting device may internally house a heating assembly adapted to heat the inner surface of the melting device, which conducts heat to the wax to melt the wax.

Although the present disclosure has been provided with reference to the foregoing operational principles and embodiments, it will be apparent to those skilled in the art that various changes in form and detail may be made without departing from the spirit and scope defined in the appended claims. The present disclosure is intended to embrace all such alternatives, modifications and variances. Where the disclosure or claims recite "a," "a first," or "another" element, or the equivalent thereof, they should be interpreted to include one or more such elements, neither requiring nor excluding two or more such elements.

What is claimed is:

1. A candle forming device, comprising:

an outer kiln that defines a chamber;

an inner mold having a closed bottom and an open top, wherein the inner mold is sized for selective placement into and out of the chamber of the outer kiln;

a heating assembly having a flat heating surface positioned to support the inner mold and heat the inner mold via thermal transfer from the flat heating surface;

a heat sink attached to the inner mold, wherein the heat sink is positioned to be in thermally conductive contact with the inner mold and for selective placement into thermally conductive contact with the flat heating surface; and a wick placement assembly configured to hold a wick in place between the open top and the bottom of the inner mold.

2. The candle forming device of claim 1, wherein the bottom of the inner mold is formed with a channel for receiving the wick and the wick placement assembly comprises a means for preventing molten wax from flowing from the inner mold.

3. The candle forming device of claim 2, wherein the heat sink is formed with a hole for allowing the wick to at least partially pass through the heat sink.

4. The candle forming device of claim 1, wherein the inner mold comprises handles positioned near a top portion of the inner mold and the handles are configured to facilitate placing the inner mold into and out of the chamber of the outer kiln.

5. The candle forming device of claim 1, wherein the heating assembly includes an electrical resistance heating element.

6. The candle forming device of claim 1, further comprising a thermostat for controlling the temperature of the chamber by regulating the thermal output of the heating assembly.

7. The candle forming device of claim 1, further comprising a control assembly for controlling operation of the heating assembly and wherein the control assembly comprises a primary operating control for selectively activating and deactivating the heating assembly.

8. The candle forming device of claim 7, wherein the heating assembly further comprises a thermostat for controlling the temperature of the chamber by regulating the thermal output of the heating assembly and the control assembly further comprises means for selectively controlling the operation of the thermostat.

9. A candle forming device, comprising:

an outer kiln having a top and a bottom, the outer kiln including a base at the bottom and at least one sidewall extending upward from the base to an opening at the top of the kiln, the opening being substantially perpendicular to the sidewall, whereby the base and sidewall define a chamber;

an inner mold having a closed bottom and an open top, the inner mold being sized for selective placement into and out of the chamber via the opening at the top of the kiln;

a heating assembly within the chamber for heating the inner mold; and a wick placement assembly configured to hold a wick in place between the open top and the bottom of the inner mold.

10. The candle forming device of claim 9, further comprising a heat sink attached to the inner mold near the bottom of the inner mold, wherein the heat sink is positioned to be in thermally conductive contact with the inner mold.

11. The candle forming device of claim 9, wherein the bottom of the inner mold is formed with a channel for receiving the wick and the wick placement assembly comprises a means for preventing molten wax from flowing from the channel.

12. The candle forming device of claim 11, further comprising a heat sink attached to the inner mold near the bottom of the inner mold, wherein the heat sink is positioned to be in thermally conductive contact with the inner mold, and wherein the heat sink is formed with a hole for allowing the wick to at least partially pass through the heat.

13. The candle forming device of claim 9, wherein the heating assembly has a flat heating surface positioned to support the inner mold and heat the inner mold via thermal transfer from the flat heating surface.

14. The candle forming device of claim 9, wherein the heating assembly comprises a shaped heating element within the chamber extending upwards from the base along the sidewall positioned to heat the inner mold via thermal transfer from the shaped heating element.

15. The candle forming device of claim 9, wherein the inner mold comprises handles positioned near a top portion of the inner mold, wherein the handles are configured to facilitate placing the inner mold into and out of the chamber of the outer kiln.

16. The candle forming device of claim 9, further comprising a removable lid for selectively closing the opening of the outer kiln, thereby substantially sealing the chamber.

17. The candle forming device of claim 9, wherein the heating assembly includes an electrical resistance heating element.

18. The candle forming device of claim 9, further comprising a thermostat for controlling the temperature of the chamber by regulating the thermal output of the heating assembly.

19. The candle forming device of claim 9, further comprising a control assembly for controlling operation of the heating assembly and wherein the control assembly further comprises a primary operating control for selectively activating and deactivating the heating assembly.

20. The candle forming device of claim 19, wherein the heating assembly further comprises a thermostat for controlling the temperature of the chamber by regulating the thermal output of the heating assembly and the control assembly further comprises means for selectively controlling the operation of the thermostat.

* * * * *